US006809716B1

(12) United States Patent
Kim

(10) Patent No.: US 6,809,716 B1
(45) Date of Patent: Oct. 26, 2004

(54) IMAGE DISPLAY APPARATUS AND METHOD FOR PROTECTING A SCREEN OF AN IMAGE DISPLAY APPARATUS

(75) Inventor: Myung Wook Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 377 days.

(21) Appl. No.: 09/638,864

(22) Filed: Aug. 15, 2000

(30) Foreign Application Priority Data

Aug. 16, 1999 (KR) ..... P1999-33701

(51) Int. Cl.[7] ..... G09G 3/36

(52) U.S. Cl. ..... 345/98; 345/660; 345/698; 345/699; 345/3.2

(58) Field of Search ..... 345/98, 611, 418, 345/660, 87, 204, 698, 699, 211–215, 3.2; 348/349, 354

(56) References Cited

U.S. PATENT DOCUMENTS 5,757,366 A * 5/1998 Suzuki
5,790,096 A * 8/1998 Hill, Jr.
5,870,073 A * 2/1999 Kitou et al.
6,097,437 A * 8/2000 Hwang
6,184,875 B1 * 2/2001 Matsuura
6,236,392 B1 * 5/2001 Inamori
6,366,292 B1 * 4/2002 Allen

* cited by examiner

*Primary Examiner*—Kee M. Tung
*Assistant Examiner*—Hau Nguyen
(74) *Attorney, Agent, or Firm*—Fleshner & Kim, LLP

(57) ABSTRACT

An apparatus for protecting a screen of the plate type image display apparatus is disclosed, in which an A/D converter converts analog R, G, B image signals into digital R, G, B image signals according a sampling clock. Also, a scaler converts the digital R, G, B image signals into a frame unit, able to be displayed on an LCD module, such as a flat panel display, and transmits the signals corresponding to a signal input timing of the LCD module. A frequency detecting part detects an output frequency of the scaler, and a microcomputer determines whether the frequency detected by the frequency detecting part is within a prescribed frequency range. In this way, a power supply for the LCD module is controlled. Thus, the power supply for the LCD module is shut off when an erroneous frequency is detected and a normal screen is displayed when a normal frequency is received so that the LCD module is better protected. The LCD module is thus protected, which could enhance reliability.

28 Claims, 2 Drawing Sheets

IMAGE DISPLAY APPARATUS AND METHOD FOR PROTECTING A SCREEN OF AN IMAGE DISPLAY APPARATUS

BACKGROUND OF THE INVENTION

1. Field of the Invention

The present invention relates to an image display apparatus, and more particularly to an apparatus and a method for protecting a screen of a plate type image display apparatus.

2. Background of the Related Art

An image display apparatus is, in general terms, an apparatus for displaying an image signal of a prescribed format that has been transmitted from a source, such as an internal video card, on a display screen. Such display is accomplished through a series of signal processing such as digital sampling and scaling.

Image display apparatuses were originally small sized image display apparatus using a cathode-ray tube. Recently, a digital type display apparatus, using a liquid crystal display (LCD) has been commercialized. It uses as a plate type displaying element appropriate for a large sized image display apparatus according to a tendency toward a large size of the display apparatus in response to the development of the modern technique.

FIG. 1 is a block diagram showing a construction of a related art plate type image display apparatus.

The related art plate type image display apparatus includes a microcomputer 1, which recognizes an input image format according to horizontal/vertical synchronized signals (H-Sync/V-Sync) transmitted from a video card, and outputs a control signal for displaying the signals according to the format. A PLL (Phase Locked Loop) 2 is included for generating a clock pulse for a selected mode according to the control signal of the microcomputer 1, and an A/D converter 3 samples R, G, B image signals transmitted from a main body according to the clock pulse provided from the PLL 2 to convert the R, G, B signals to digital signals.

The apparatus further includes a scaler 4 for converting the digital R, G, B image signals output from the A/D converter 1 to a frame unit to be displayed on a liquid crystal display (LCD) module to transmit according to a signal input timing of the LCD module. A Tx 6 is provided to compress the output signal from the scaler 4 to transmit, and an LCD module 7 is provided to restore the compressed signal output from the Tx 6. The LCD module 7 is further used for driving a liquid crystal to display a screen. An inverter 8 drives a lamp 7*c* in the LCD module 7.

Further, the I-CD module 7 includes an Rx 7*a* for restoring the compressed signal output from the Tx 6, a TFT control part 7*b* for driving the liquid crystal according to the signal input from the Rx 7*a* to control the screen to be displayed, and the lamp 7*c*.

The operation of the related art plate type image display apparatus will next be described.

First, the microcomputer 1 recognizes a resolution of the horizontal/vertical synchronized signal transmitted from the video card as the signal is input. The microprocessor also controls the driving of a power supply and the lamp.

The microcomputer 1 outputs a control signal to the PLL 2 for setting a sampling clock used by the A/D converter 3 to convert the input image signal into a digital signal. The resulting resolution corresponds to a resolution preset by a user and a resolution supported by the plate type image display apparatus.

The PLL 2 sets a sampling clock per mode according to a control signal output from the microcomputer 1, and the A/D converter 3 samples the analog R, G, B image signals transmitted from the main body according to the clock pulse provided from the PLL 2. The analog R, G, B signals are thus converted to digital R, G, B signals.

For example, the digital sampling for an XGA signal is performed by generating a sampling clock of 65MHz according to a horizontal synchronizing signal timing for sampling the XGA image signal so that 8 bit digital R, G, B image signals are output.

The scaler 4 performs a signal processing of the digital R, G, B image signals output from the A/D converter 3 according to the control signal of the microcomputer 1 by a frame unit, and a frame buffer memory 5 stores an output from the scaler by the frame unit.

The Tx 6 then transmits the digital R, G, B image signals stored in the frame buffer memory after compressing.

The LCD module 7 drives the liquid crystal to display the screen by applying an output signal from the scaler 4 to the TFT control part 7*b* or the signal compressed by the Tx 6 and received via the Rx 7*a* to the TFT control part 7*b*.

Further, the inverter 8 drives the lamp 7*c* in the LCD module 7 according to a control signal of the microcomputer 1. That is, the LCD module 7 and the lamp 7*c* are turned off only when the user turns off the power supply. A chlorosis is otherwise generated when an abnormal horizontal/vertical synchronizing signal is input.

The plate type image display apparatus of the related art as describe above has several disadvantages. For example, the plate type image display apparatus can not recognize data, power supply, and synchronizing signals applied to the plate type display apparatus in an abnormal sequence. If such an abnormal signal is applied, the LCD module may be damaged. Further, when abnormal data is input, the whole screen of the plate type image display apparatus is displayed white due to the chlorosis since the abnormal data input can not be recognized.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide an apparatus and a method for protecting the screen of an image display apparatus that substantially obviate one or more of the problems due to limitations and disadvantages of the related art.

Another object of the present invention is to detect abnormal input data.

Another object of the present invention is to control the driving of at least one of the power supply and the lamp in a display apparatus.

A further object of the present invention is to display a normal screen on an image display by compensating errors.

A further object of the present invention is to prevent chlorosis in a display module.

To achieve at least these and other advantages in whole or in parts there is provided an apparatus for protecting a screen of a plate type image display apparatus including a liquid crystal display (LCD) module and an inverter, comprising an A/D converter for converting an analogue image signal into a digital image signal according to a sampling clock, a scaler for converting digital R, G, B image signals output from the A/D converter into a frame unit able to be displayed on the LCD module to transmit according to a signal input timing of the LCD module, a frequency detecting part for detecting an output frequency of a signal output from the scaler; and a microcomputer for controlling power supply to the LCD module and the inverter by determining whether the output frequency detected by the frequency detecting part is within a predetermined preset frequency range.

To further achieve at least the above described advantages in whole or in parts, there is provided a method for protecting a screen of a plate type image display apparatus including an A/D converter, a scaler, an inverter and a liquid crystal display (LCD) module includes determining whether an output frequency of the scaler is within a predetermined preset frequency range or not, turning off power supply of the inverter and the LCD module and initializing the A/D converter and the scaler if the detected output frequency is not in the predetermined preset frequency range, and turning on the power supply of the inverter and the LCD module and displaying a normal screen if the detected output frequency is in the predetermined preset frequency range.

To further achieve at least the above described advantages in whole or in parts, there is provided an image display apparatus that includes a scaler to convert image signals into a frame unit to be displayed on an LCD module, and to transmit the signals corresponding to a signal input timing of the LCD module, a frequency detector detect an output frequency of the scaler, and a microcomputer to determine whether the output frequency detected by the frequency detector is within a prescribed frequency range, and to control a power supply for the LCD module.

To further achieve at least the above described advantages in whole or in parts, there is provided a method for protecting a screen of an image display apparatus that includes determining whether an output frequency of a scaler is within a prescribed frequency range, turning off a power supply of a LCD module and initializing the scaler if the detected output frequency is not within the prescribed frequency range, and turning on the power supply of the LCD module and displaying a normal screen if the detected output frequency is within the prescribed frequency range.

To further achieve at least the above described advantages in whole or in parts, there is provided an image display apparatus that includes a video signal processor to receive a video signal of a first format and output a video signal of a second format, a formatter to format the signal of the second format for displaying an output screen, an output module to provide the formatted signal from the formatter to the output screen, and a control unit, which detects the frequency of the formatted signal from the formatter, and prevents the operation of the output module if the frequency is outside of a prescribed range.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
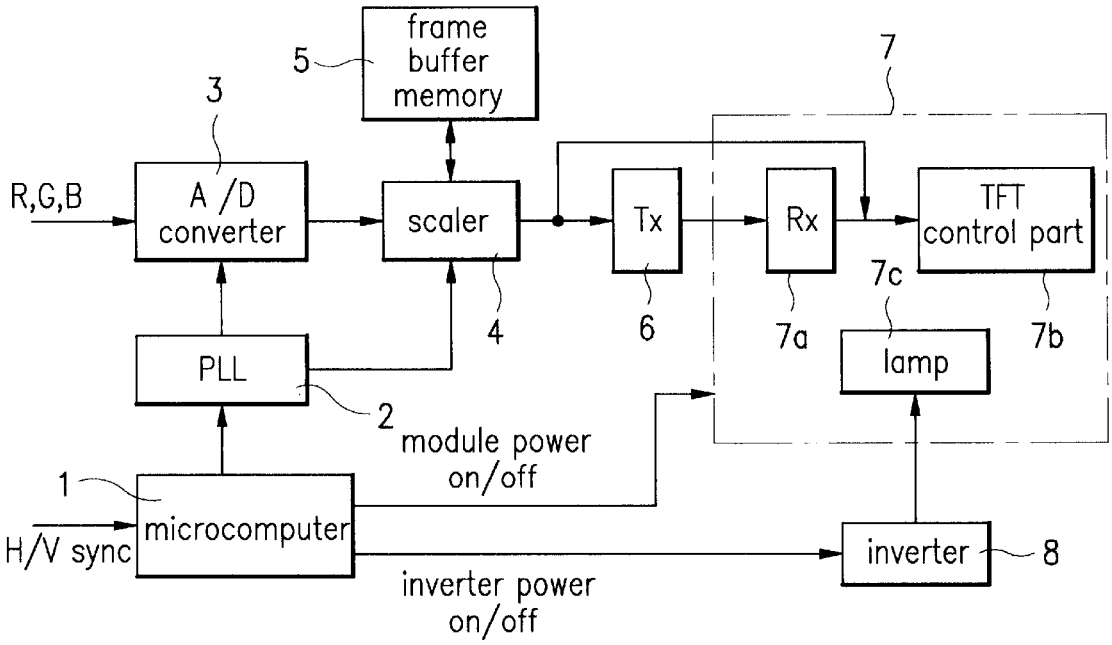
FIG.1 prior art
FIG. 1 is a drawing that shows a view of a related art plate type image display apparatus.
Figure 2:
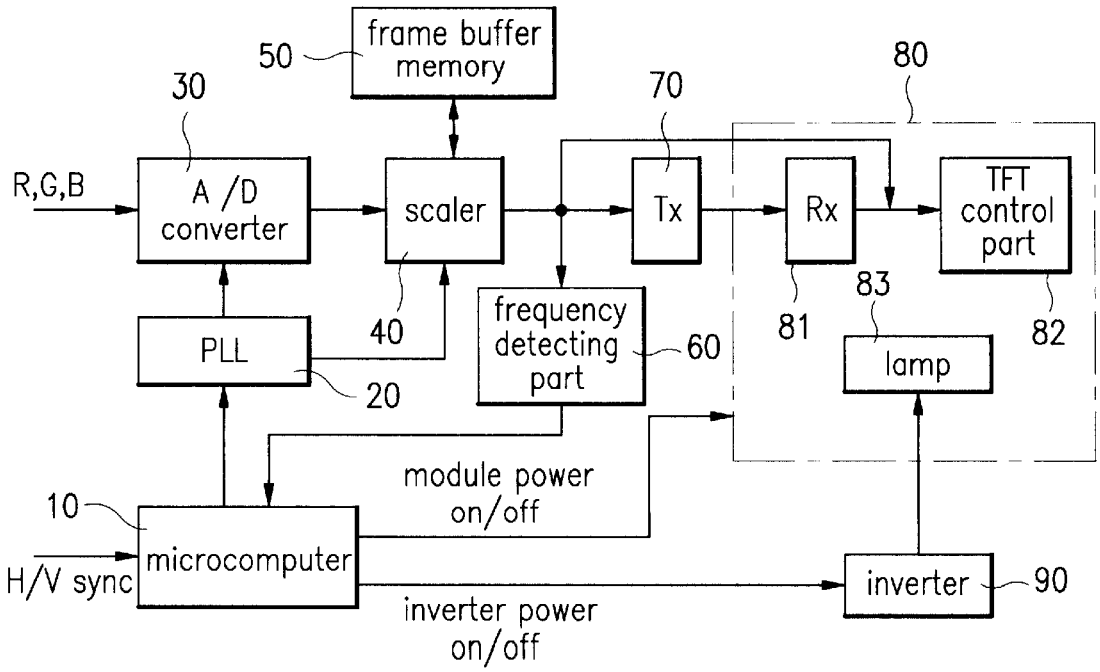
FIG. 2 is a drawing that shows a view of an apparatus for protecting a screen of a plate type image display apparatus according to a preferred embodiment of the present invention.

As shown in FIG. 2, an apparatus for protecting a screen of a plate type image display apparatus according to a preferred embodiment includes a microcomputer 10 for recognizing an input image format according to a horizontal/vertical synchronizing (H-Sync/V-Sync) signal transmitted from a source, such as a video card. A PLL (Phase Locked Loop) 20 is provided to generate a clock pulse per mode according to a control signal of the microcomputer i, and an A/D converter 30 is provided to sample R, G, B image signals transmitted from a main body to convert the image signals into digital R. G, B image signals according to a clock pulse provided from the PLL 20.

The apparatus further includes a scaler 40 for converting the digital R, G, B image signals output from the A/D converter 30 into a frame unit, able to be displayed on the LCD module, to transmit according to a signal input timing of the LCD module. A frame buffer memory 50 is provided to store the image signals converted by the scaler 40 by a frame unit, and a frequency detecting part 60 is provided for detecting an output frequency of the scaler 40.

The apparatus further includes a Tx 70 for compressing the output signal from the scaler 40 to transmit, a liquid crystal-display(LCD) module 80 for driving a liquid crystal to display a screen according the output from the scaler 40 or the signal compressed by the Tx 70, and an inverter 90 for driving a lamp 83 in the LCD module 80.

The LCD module 80 includes an Rx 81 for restoring the signal compressed by the Tx 70, a TFT control part 82 for driving the liquid crystal according to the signal input from the Rx 70 or the scaler 40 to display the screen, and the lamp 83 to be driven according to a control signal of the microcomputer 10.

The operation of the apparatus for protecting a screen of a plate type image display apparatus constructed as above will next be described.

The microcomputer 1 preferably recognizes a resolution of an input horizontal/vertical synchronized signal and outputs a control signal. This is done by compensating an error of the input data according to a detection result, which determines whether an output frequency of the scaler 40 detected by the frequency detecting part 60 is within a prescribed frequency range.

The PLL 20 sets a clock pulse per mode according to a control signal output from the microcomputer 1, and the AID converter 30 samples the analog R, G, B image signals transmitted from a video card according to the clock pulse provided from the PLL 20. The analog image signals are thus converted to digital. R, G, B signals.

The scaler 40 adjusts an output from the AID converter 30 by a frame unit corresponding to a prescribed resolution according to the control signal of the microcomputer 10, and the frame buffer memory 50 stores the adjusted image signal output from the scaler 40 by the frame unit.

The frequency detecting part 60 next detects an output frequency of the scaler 40 and transmits the detected output frequency to the microcomputer 10.

The Tx 70 transmits the signals output from the scaler 40 after compression, and the Rx 81 restores the compressed image signal input from the Tx 70 to an original image signal.

The TFT control part 82 drives the liquid crystal to display the screen by receiving an output signal from the scaler 40 or the Tx 81. The inverter 90 drives the lamp 83 in the LCD module 80 according to a control signal of the microcomputer 10.

Specifically, the power supply to the LCD module 80 and the inverter 90 is shorted and the A/D converter 30 and the scaler 40 are initialized if the frequency detected by the frequency detection part 60 out of the prescribed frequency range.

Then, an output frequency of the scaler 40 is detected again and a normal screen is displayed by applying the power supply to the LCD module 80 and the inverter 90 if the re-detected output frequency is within the prescribed frequency range.

Now, a method for protecting a screen of a plate type image display apparatus according to a preferred embodiment of the present invention will be described.

Figure 3:
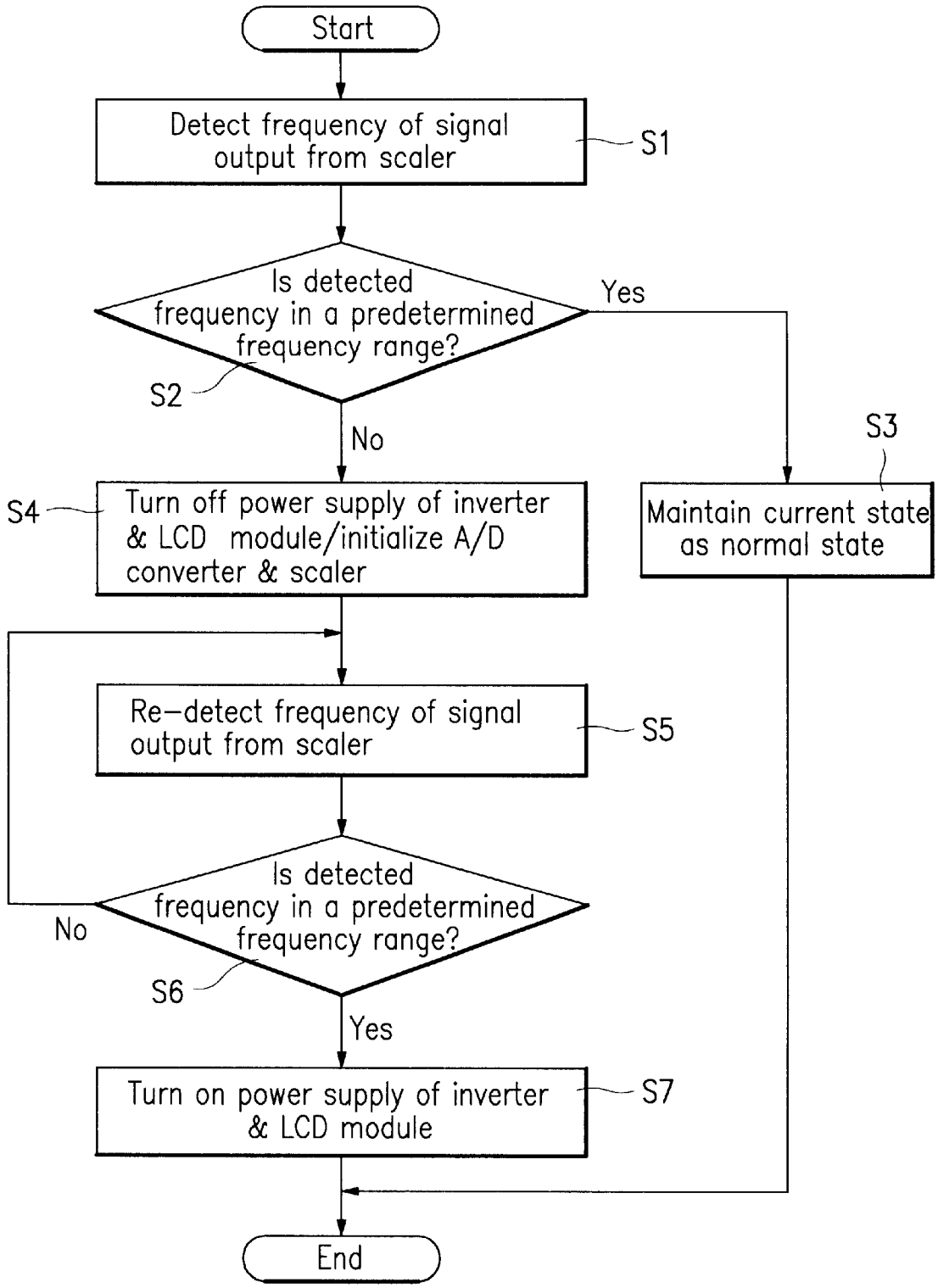
FIG. 3 is a flowchart that shows a method for protecting a screen of a plate type image display apparatus according to a preferred embodiment of the present invention.

Referring to FIG. 3, a frequency of an output from the scaler 40 is detected as shown in step S1. Next, it is determined whether the detected frequency is within a prescribed frequency range, as shown in step S2. The prescribed preset frequency range is preferably a range of error of an input frequency of the LCD module.

According to the result of the determination from step S2, a screen is displayed in a normal state by maintaining a current normal state, if the detected frequency is within the prescribed frequency range as shown in step S3.

If, on the other hand, the detected frequency is not within the prescribed frequency range as a result of the determination, the power supply for the LCD module 80 and the inverter 90 is turned off and the A/D converter 30 and the scaler 40 are initialized in response to the turning off of the power supply for the LCD module 80 and the inverter 90 as shown in step S4.

Then, a frequency of an output from the scaler 40 is re-detected according to step S5 and analyzed to determine whether the frequency is within the prescribed frequency range, as shown in step S6.

According to the result of the determination in step S6, the normal screen is displayed by turning on the power supply for the LCD module 80 and the inverter 90 if the detected frequency is within the predetermined preset frequency range as shown in step S7.

As described herein, in the apparatus and the method for protecting a screen of a plate type image display apparatus according to the preferred embodiment of the present invention, a current state is maintained if a detected output frequency of the scaler 40 is within a prescribed frequency range. Additionally, a power supply for the LCD module 80 and the inverter 90 is turned off, so as to minimize the damage to the screen if the detected output is not within the prescribed frequency range based on the output frequency of the scaler 40.

Further, if the power supply for the LCD module 80 and the inverter 90 is turned off, the A/D converter 30 and the scaler 40 are initialized (for example, reset), and an output frequency of an applied data is detected again to determine whether the frequency is existing within the prescribed frequency range.

As a result of the secondary determination, if the re-detected output frequency is within the prescribed frequency range, the LCD module 80 and the inverter 90 are preferably normally supplied with power from the power supply and the normal screen is displayed.

The apparatus and the method for protecting a screen of a plate type image display apparatus according to the present invention has many advantages.

For example, the chlorosis generated due to the generation of an error may be prevented in advance by shutting off the power supply applied to the LCD module, so as to temporarily stop a screen state. This is accomplished by generating an error when a detected frequency of an output from the scaler deviates from a predetermined frequency range, and a normal operation is performed if a normal signal is applied.

Moreover, the LCD module may be protected by preventing the chlorosis due to the generation of error in advance.

Also, the reliability of products may be improved by providing a normal screen state to a user by compensating errors.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An image display apparatus, comprising:

a scaler to convert video image signals into a frame unit to be displayed on an LCD module, and to transmit the signals corresponding to a signal input timing of the LCD module;

a frequency detector to detect an output frequency of the video signal outputted by the scaler; and a microcomputer to determine whether the detected frequency is within a prescribed frequency range, and to control a power supply for the LCD module in accordance with the frequency determination.

2. The apparatus of claim 1, wherein the microcomputer shuts off the power supply for the LCD module and an inverter if the output frequency of the scaler detected by the frequency detector is not within the prescribed frequency range.

3. The apparatus of claim 1, wherein the microcomputer outputs a control signal to control a display according to an image format corresponding to a horizontal/vertical synchronizing signal (H-Sync/V-Sync).

4. The apparatus of claim 1, wherein the image signals are one of analog R, G, B image signals and digital R, G, B image signals.

5. The apparatus of claim 4, further comprising:

an A/D converter to convert analog R, G, B image signals into digital R, G, B image signals; and a Phase Locked Loop (PLL) to provide a sampling clock for the A/D converter.

6. A method for protecting a screen of an image display apparatus, comprising:

determining whether a frequency of a video image signal output from a scaler is within a prescribed frequency range by detecting the frequency of the video image signal;

turning off a power supply of a LCD module and initializing the scaler if the detected frequency of the video image signal is not within the prescribed frequency range; and turning on the power supply of the LCD module and displaying a normal screen if the detected frequency of the video image signal is within the prescribed frequency range.

7. The method of claim 6, further comprising displaying a current normal screen if the initially detected output frequency is within the prescribed frequency range.

8. The method of claim 6, wherein the screen is in a temporary stop situation if the power supply for the LCD module and an inverter is turned off.

9. The method of claim 6, wherein an output frequency of the scaler is continuously detected if a secondarily detected output frequency of the scaler is not within the prescribed frequency range.

10. The method of claim 6, wherein the prescribed frequency range comprises a range of an error of an input frequency of the LCD module.

11. The method of claim 6, further comprising initializing an A/D converter if the detected output frequency is not within the prescribed frequency range.

12. An image display apparatus, comprising:

a video signal processor to receive a video image signal of a first format and output a video image signal of a second format;

a scaler circuit coupled to receive and format the video image signal of the second format for displaying on an output screen;

an output module to provide the formatted video image signal from the formatter to the output screen; and a control unit, which detects a frequency of the formatted video image signal from the scaler circuit, and prevents the operation of the output module if the frequency is outside of a prescribed range.

13. The apparatus of claim 12, wherein the first format comprises analog R, G, B image signals and the second format comprises digital R. G. B image signals.

14. The apparatus of claim 12, wherein the scaler circuit comprises:

a scaler to convert the video image signal of the second format into a frame unit;

a frame buffer to store the frame unit; and a transmitter coupled to the scaler to compress the frame unit signal and provide the compressed frame unit signal to the output module.

15. The apparatus of claim 12, wherein the video signal processor comprises:

a microcomputer, coupled to receive horizontal and vertical synchronizing signals and generate a control signal;

a Phase Locked Loop (PLL), to generate a clock frequency based on the control signal; and a format converter to convert the first video image signal format to the second video image signal format in accordance with the clock frequency.

16. The apparatus of claim 12, wherein the control unit comprises a frequency detector.

17. The apparatus of claim 12, wherein the output module comprises a flat panel display.

18. The apparatus of claim 12, wherein the output module comprises a video receiver to receive the formatted signal, a control part to drive the display, and a lamp.

19. The apparatus of claim 18, wherein the video signal processor prevents the supply of power to the output module when the control unit determines that the frequency of the formatted signal is outside of the prescribed range.

20. The apparatus of claim 18, wherein the receiver receives and decompresses a compressed video signal formatted for a frame, and the controller is a TFT controller to drive a liquid crystal display.

21. The apparatus of claim 1, wherein the microcomputer is coupled to receive horizontal and vertical synchronization signals corresponding to the image signals converted by the scaler.

22. The apparatus for 21, wherein the image signals comprise one of analog RGB image signals and digital RGB image signals.

23. The apparatus of claim 5, wherein the PLL generates the sampling clock based on horizontal and vertical sink signals corresponding to the analog RGB image signals.

24. The method of claim 6, wherein the frame unit image signals comprise digital RGB signals.

25. The apparatus of claim 12, wherein the video image signal of the first format is a digital RGB signal.

26. The apparatus in claim 12, wherein the control unit initializes is the formatter if the frequency of the formatted video image signal is outside of the prescribed range.

27. The apparatus of claim 15, wherein the first format is an analog RGB format, and wherein the second format is a digital RGB format.

28. The apparatus of claim 12, wherein the control unit prevents the operation of the output module by controlling a power supply of the output module according to the frequency of the formatted video image signal.

* * * * *